United States Patent [19]

Ikenoue et al.

[11] 4,170,480

[45] Oct. 9, 1979

[54] THERMALLY DEVELOPABLE LIGHT-SENSITIVE MATERIAL

[75] Inventors: Shinpei Ikenoue; Takao Masuda; Harumi Katsuyama; Nobuyoshi Sekikawa, all of Asaka; Tadao Shishido; Nobuo Sakai, both of Minami-ashigara, all of Japan

[73] Assignee: Fuji Photo Film Co., Ltd., Minami-ashigara, Japan

[21] Appl. No.: 831,315

[22] Filed: Sep. 7, 1977

[30] Foreign Application Priority Data

Sep. 7, 1976 [JP] Japan ..... 51-107017

[51] Int. Cl.[2] ..... G03C 1/02; G03C 1/34

[52] U.S. Cl. ..... 96/114.1; 96/109

[58] Field of Search ..... 96/114.1, 109; 428/913; 250/316, 317

[56] References Cited

U.S. PATENT DOCUMENTS

| | | | |
|---|---|---|---|
| 3,617,289 | 11/1971 | Ohkubo et al. | 96/114.1 |
| 3,832,186 | 8/1974 | Masuda et al. | 96/114.1 |
| 3,893,860 | 7/1975 | Sutton et al. | 96/114.1 |
| 4,065,312 | 12/1977 | Weyde et al. | 96/114.1 |

FOREIGN PATENT DOCUMENTS

| | | | |
|---|---|---|---|
| 2641964 | 3/1977 | Fed. Rep. of Germany | 96/114.1 |

*Primary Examiner*—Mary F. Kelley

*Attorney, Agent, or Firm*—Sughrue, Rothwell, Mion, Zinn and Macpeak

[57] ABSTRACT

A thermally developable light-sensitive material comprising a support having therein or in at least one layer thereon (a) an organic silver salt, (b) a photocatalyst, and (c) a reducing agent, and additionally (d) at least one 1,2,4-triazole compound.

9 Claims, No Drawings

THERMALLY DEVELOPABLE LIGHT-SENSITIVE MATERIAL

BACKGROUND OF THE INVENTION

1. FIELD OF THE INVENTION

The present invention relates to a thermally developable light-sensitive material and, more particularly, to a thermally developable light-sensitive material in which heat fog (the disadvantageous blackening of unexposed areas occurring upon thermal development) does not occur.

2. DESCRIPTION OF THE PRIOR ART

It is known to obtain photographic images by subjecting a photographic material containing a light-sensitive element such as silver halide to a so-called dry processing by heating. Of light-sensitive materials capable of forming photographic images through such a dry processing, a thermally developable light-sensitive material utilizing a composition containing an organic acid silver salt (e.g., silver behenate, etc.), a reducing agent and a slight amount of a photocatalyst such as a light-sensitive silver halide as necessary components, e.g., as described in U.S. Pat. Nos. 3,152,904, 3,457,075, 3,707,377, 3,909,271, etc., is at present expected to be the most promising. This light-sensitive material is stable at ordinary temperature but, when heated to usually not less than about 80° C. (preferably not less than 100° C.) after imagewise exposure, the organic silver salt oxidizing agent and the reducing agent undergo an oxidation-reduction reaction under the catalytic action of the exposed photocatalyst such as silver halide present in the vicinity thereof to form silver. Thus, the exposed areas of a light-sensitive layer are rapidly blackened to generate a contrast between the exposed areas and the unexposed areas (background) and form images.

In this light-sensitive system, a photocatalyst such as silver halide remaining in the light-sensitive material after development is not stabilized against light and is allowed to freely discolor. In spite of this lack of stabilization, the same effects as that attained by stabilizing the catalyst can be attained. Because, the photocatalyst such as silver halide is used in such a small amount, with most of the silver salt comprising a stable white or slightly colored organic silver salt which is difficulty blackened with light, that even when a slight amount of the photocatalyst such as silver halide is discolored by light, it appears as a whole white or only lightly colored. Therefore, such a slight discoloration is not visually disadvantageous.

However, one of the defects of the thermally developable light-sensitive materials described in U.S. Pat. Nos. 3,457,075, 3,152,904, etc., is that the unexposed areas tend to be developed as well upon thermal development, i.e., heat fog tends to be generated.

Various techniques are known to prevent generation of heat fog. Such techniques are described in, for example, U.S. Pat. No. 3,589,903, Japanese patent application (OPI) Nos. 10,724/74, 97,613/74, 90,118/74, 22,431/76, U.S. Pat. No. 3,885,968, Japanese patent application (OPI) Nos. 101,019/75, 116,024/75, 123,331/75, 134,421/75, 3,223/76, 42,529/76, 47,419/76, 54,428/76, 57,435/76, 78,227/76, etc. However, these techniques fail to completely solve the problems, and heat fog is not sufficiently depressed.

In addition, conventional thermally developable light-sensitive materials do not have sufficient latitude for thermal development. In particular, thermally developable light-sensitive materials which have been stored for a long period of time after the production thereof tend to have a narrow latitude for thermal development.

Further, when stored for a long period of time after the production thereof, light-sensitive materials in which heat fog is prevented tend to suffer a reduction in sensitivity.

SUMMARY OF THE INVENTION

As a result of intensive investigations for solving the above-described problems encountered with conventional techniques, the present invention has been achieved.

That is, an object of the present invention is to provide a thermally developable light-sensitive material generating less heat fog.

Another object of the present invention is to provide a thermally developable light-sensitive material having a broad latitude for thermal development.

A further object of the present invention is to provide a thermally developable light-sensitive material undergoing less of a reduction in sensitivity during storage.

Still a further object of the present invention is to provide a thermally developable light-sensitive material undergoing less of a deterioration in development latitude during storage.

These objects are attained by the present invention.

That is, the present invention provides a thermally developable light-sensitive material comprising a support having provided therein or in at least one layer thereon (a) an organic silver salt, (b) a photocatalyst and (c) a reducing agent, and additionally (d) at least one 1,2,4-triazole compound.

DETAILED DESCRIPTION OF THE INVENTION

Component (d), which is the most characteristic aspect of the present invention, is a 1,2,4-triazole compound. This 1,2,4-triazole compound includes the compound represented by the following general formula (I):

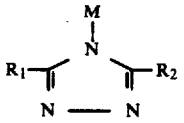

(I)

wherein M represents a hydrogen atom or an alkali metal atom (e.g., sodium, potassium, lithium, etc.), and $R_1$ and $R_2$, which may be the same or different, each represents a halogen atom (e.g., chlorine, bromine, iodine, etc.), a nitro group or a carbon-containing substituent which may contain one or more of a nitrogen atom(s), an oxygen atom(s) or a sulfur atom(s) and which substituent preferably contains 1 to 18 carbon atoms, particularly preferably 2 to 14 carbon atoms.

Preferred examples of such carbon-containing substituents include an alkyl group, an aryl group, a substituted oxy group, a substituted thio group, a substituted sulfinyl group, a substituted sulfonyl group, a substituted amino group, and a heterocyclic ring residue.

Each of the above-described carbon-containing substituents represented by $R_1$ and $R_2$ are described in greater detail below.

(1) Alkyl groups:

Alkyl groups having 1 to 18 carbon atoms, in particular, 2 to 14 carbon atoms and which may be straight chain, branched chain or cyclic (e.g., a methyl group, an ethyl group, a propyl group, a butyl group, a heptyl group, a nonyl group, a lauryl group, etc.) are preferred. The alkyl groups may be substituted with one or more substituents as follows:

(i) halogen atoms (e.g., chlorine, bromine, iodine, etc.);
(ii) hydroxyl groups;
(iii) carboxyl groups;
(iv) carbon-containing substituents having 1 to 12 carbon atoms; preferably an aryl group, which may be mono- or bicyclic, such as a phenyl group or a naphthyl group, in which these aryl groups may be substituted with one or more of an alkyl group having 1 to 3 carbon atoms (e.g., a methyl group, an ethyl group, a propyl group, etc.) or with a halogen atom (e.g., chlorine, bromine, iodine, etc.), such as a phenyl group, a p-methylphenyl group, a p-chlorophenyl group, etc.; and an alkoxy group having 1 to 12 carbon atoms and in which the alkyl moiety thereof may be straight chain or branched chain (e.g., a methoxy group, an ethoxy group, a propoxy group, a butoxy group, etc.).

Preferred alkyl groups for $R_1$ and $R_2$ include a methyl group, an ethyl group, a propyl group, a butyl group, a pentyl group, a hexyl group, a cyclohexyl group, a heptyl group, an octyl group, a decyl group, a dodecyl group, a benzyl group, a 2-phenylethyl group, a methoxyethyl group, a carboxymethyl group, a 2-carboxyethyl group, a 3-carboxypropyl group, a 2-hydroxyethyl group, a 2-bromoethyl group, etc.

(2) Aryl groups:

Aryl groups having 6 to 18 carbon atoms, which may be mono- or bicyclic, are preferred. The aryl groups may be substituted with one or more of the following subsitutents:

(i) halogen atoms (e.g., chorine, bromine, iodine, etc.);
(ii) nitro groups;
(iii) hydroxyl groups;
(iv) carboxyl groups;
(v) carbon-containing substituents having 1 to 12 carbon atoms such as an alkyl group, which may be straight chain, branched chain or cyclic (e.g., a methyl group, an ethyl group, a propyl group, a butyl group, etc.), a phenyl group or a naphthyl group, in which these aryl groups may be substituted with one or more of an alkyl group having 1 to 3 carbon atoms (e.g., a methyl group, an ethyl group, a propyl group, etc.) or a halogen atom (e.g., a chlorine atom, a bromine atom, an iodine atom, etc.), such as a phenyl group, a p-methylphenyl group, a p-chlorophenyl group, etc., or the like.

Preferred aryl groups for $R_1$ and $R_2$ include a phenyl group, a tolyl group,, a xylyl group, a biphenyl group, a naphthyl group, a p-carboxyphenyl group, a p-methoxyphenyl group, a p-chlorophenyl group, a p-nitrophenyl group, etc.

(3) Substituted oxy groups, substituted thio groups, substituted sulfinyl groups, substituted sulfonyl groups and substituted amino groups which can be represented by the following general formulas, respectively.

R'—O—
R'—S—
R'—$SO_2$—
R'—$SO_3$—
$R'_n$—$NH_m$— or
R''=N—

In the above formulas, n and m each represents 0 or an integer of 1 or 2, where n+m=2; and R' represents a carbon-containing substituent having 1 to 12 carbon atoms such as:

an alkyl group having 1 to 12 carbon atoms, which may be straight chain, branched chain or cyclic, and which may be substituted with one or more substituents such as a halogen atom (e.g., a chlorine atom, a bromine atom, an iodine atom, etc.), a hydroxyl group, a carboxyl group, an alkoxy group having 1 to 11 carbon atoms, in which the alkyl moiety may be straight chain, branched chain or cyclic (e.g., a methoxy group, an ethoxy group, a butoxy group, etc.), an aryl group having 6 to 12 carbon atoms, which may be mono- or bicyclic (e.g., a phenyl group, a p-methylphenyl group, a p-chlorophenyl group, etc.); an aryl group having 6 to 12 carbon atoms, which may be mono- or bicyclic, and which may be substituted with one or more substituents such as a halogen atom (e.g., a chlorine atom, a bromine atom, an iodine atom, etc.), a carboxyl group, an alkyl group having 1 to 6 carbon atoms, which may be straight chain, branched chain or cyclic (e.g., a methyl group, an ethyl group, a propyl group, a butyl group, etc.), an aryl group having 6 to 12 carbon atoms, which may be mono- or bicyclic (e.g., a phenyl group, a p-methylphenyl group, a p-chlorophenyl group, etc.); an acyl group such as an alkylcarbonyl group having 2 to 12 carbon atoms, in which the alkyl moiety thereof may be straight chain, branched chain or cyclic, and which may be substituted with one or more substituents such as a halogen atom (e.g., a chlorine atom, a bromine atom, an iodine atom, etc.), a hydroxyl group, a carboxyl group, an alkoxy group having 1 to 11 carbon atoms, in which the alkyl moiety may be straight chain, branched chain or cyclic (e.g., a methoxy group, an ethoxy group, a butoxy group, etc.), an aryl group having 6 to 12 carbon atoms, which may be mono- or bicyclic (e.g., a phenyl group, a p-methylphenyl group, a p-chlorophenyl group, etc.), and an arylcarbonyl group having 7 to 13 carbon atoms, which may be mono- or bicyclic, and which may be substituted with one or more substituents such as a halogen atom (e.g., a chlorine atom, a bromine atom, an iodine atom, etc.), a carboxyl group, an alkyl group having 1 to 6 carbon atoms, which may be straight chain, branched chain or cyclic (e.g., a methyl group, an ethyl group, a propyl group, a butyl group, etc.), an aryl group having 6 to 12 carbon atoms, which may be mono- or bicyclic (e.g., a phenyl group, a p-methylphenyl group, a p-chlorophenyl group, etc.); or a nitro group.

Preferred examples of R' include a methyl group, an ethyl group, a butyl group, a pentyl group, a hexyl group, a cyclohexyl group, a heptyl group, an octyl group, a decyl group, a dodecyl group, a benzyl group, a 2-(phenyl)ethyl group, a methoxymethyl group, a carboxymethyl group, a 2-(bromo)ethyl group, a phenyl group, a tolyl group, a xylyl group, a biphenyl group, a naphthyl group, a p-nitrophenyl group, a p-chlorophenyl group, a p-carboxyphenyl group, etc.

In the above-described formulas, R'' represents a 5- or 6-membered heterocyclic ring containing a nitrogen atom, which may form a fused ring together with a benzene nucleus, and which may be substituted with one or more alkyl groups having 1 to 4 carbon atoms, which may be straight chain or branched chain (e.g., a methyl group, an ethyl group, a propyl group, a butyl group, etc.). Preferably, R″ represents a heterocyclic ring containing one nitrogen atom and one or more additional hetero atoms (e.g., N, O or S). Specific examples of such heterocyclic rings include 2-(N-benzylbenzothiazolidene), 2-(N-methylthiazolidene), 2-(N-ethylbenzoxazolidene), 2-(N-ethyloxazolidene), 2-(N-methylbenzimidazolidene), etc., rings.

(4) Heterocyclic rings:

5- or 6-membered heterocyclic rings (which may form a fused ring together with a benzene nucleus) are preferred, which may be substituted with one or more substituents which do not exert a detrimental influence on the present invention, e.g., substituents such as one or more alkyl groups having 1 to 4 carbon atoms, which may be straight chain, or branched chain (e.g., a methyl group, an ethyl group, a propyl group, etc.). Specific examples include a 2-furyl group, a 2-pyrrolyl group, a 1-pyrrolyl group, a 1-pyrazolyl group, etc.

$R_1$ and $R_2$ may be the same or different but $R_1$ and $R_2$ are preferably the same.

Preferred specific examples of the 1,2,4-triazole compounds of the present invention, as component (d), are illustrated below.

(1)
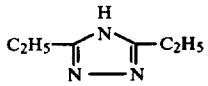

(2)
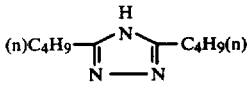

(3)
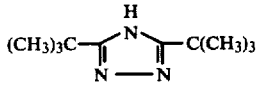

(4)
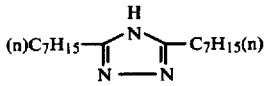

(5)
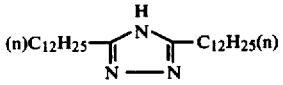

(6)
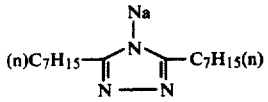

(7)
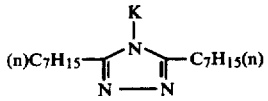

(8)
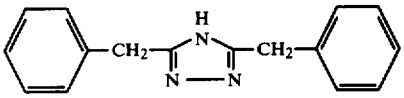

(9)
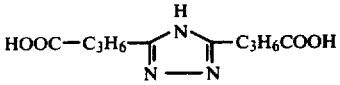

(10)
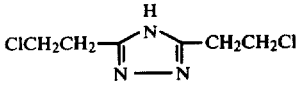

(11)
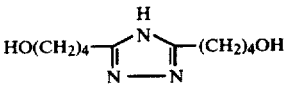

-continued

(12)
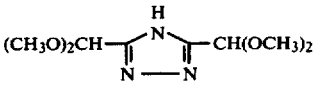

(13)
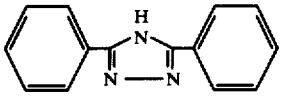

(14)
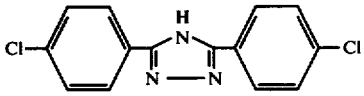

(15)
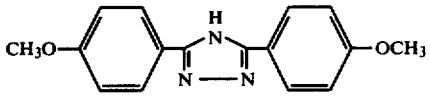

(16)
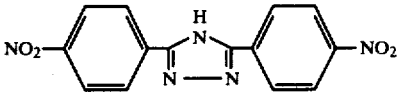

(17)
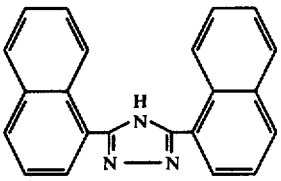

(18)
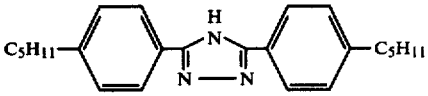

(19)
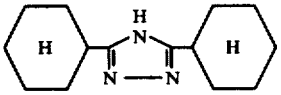

(20)
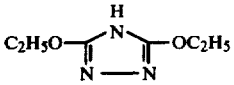

(21)
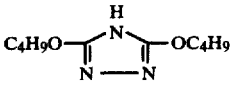

(22)
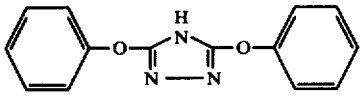

(23)
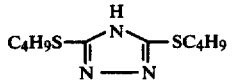

(24)
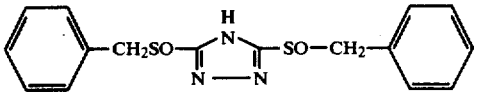

(25)
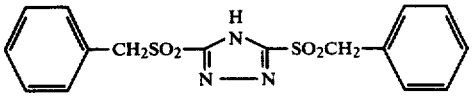

(26)
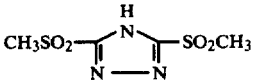

(27)
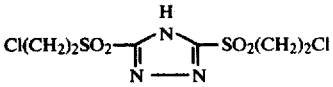

(28)
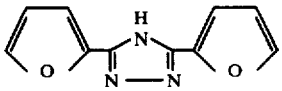

-continued (29)

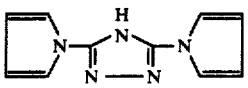

(30)

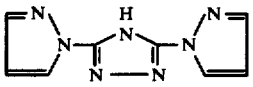

(31)

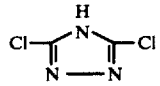

(32)

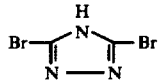

(33)

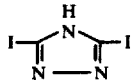

(34)

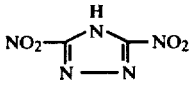

(35)

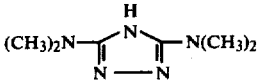

(36)

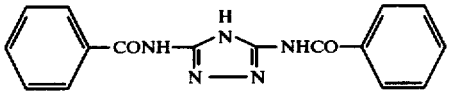

(37)

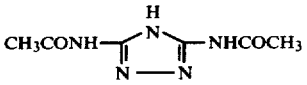

(38)

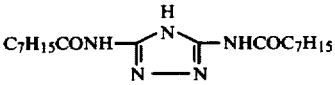

(39)

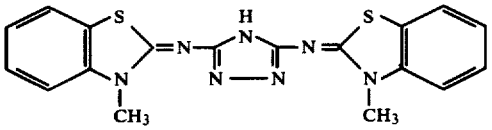

Of the 1,2,4-triazole compounds set forth above, Compounds (1)–(7), (10) and (11) are particularly preferred.

The above-described 1,2,4-triazoles can be synthesized according to known processes. For example, as is described in R. C. Elderfield, Heterocyclic Comp., Vol. 7, p. 433, John Wiley & Sons, Inc., (1957), or Daiyuki Kagaku 15, Heterocyclic Compounds II (compiled under the supervision of Munio Kotake), p. 391, Asakura Publishing Co., Ltd., (1962), various 1,2,4-triazole derivatives can be obtained by heating a primary acylhydrazine together with an acid amide or an acid anilide, by heating an acid amide together with an acid hydrazide, by heating an acid amide together with hydrazine hydrochloride, by independently heating a primary acylhydrazine to convert such to an N-aminotriazole derivative and reacting nitrous acid therewith to remove the amino group, by reacting semi-carbazide hydrochloride with a diacylamide in the presence of sodium acetate, by reacting zinc chloride-ammonia or a primary amine with a diacylhydrazine or like processes. In addition, amide derivatives can be obtained by reacting amine derivatives with an acid chloride, a substituted p-toluenesulfonate, etc., in the presence of a base. All of these processes are well known to those skilled in the art.

The optimum amount of component (d) employed will vary depending upon the kind of component (d), the kind of organic silver salt (a) used, the manner of preparing the thermally developable light-sensitive composition, etc. Therefore, the optimum amount must be determined experimentally with particular component (d) and a particular composition.

In general, however, component (d) is used in a range of from about $10^{-5}$ mol to 0.5 mol, preferably from $10^{-4}$ mol to 0.1 mol, per mol of the organic silver salt (a).

If the amount used is too small, the fog-preventing action will be insufficient, whereas, if the amount is too large, reduction of development speed will result.

Component (d) is preferably added after formation of the organic silver salt (a). Also, when component (b) is a light-sensitive silver halide, component (d) is preferably added after formation of a mixture of the organic silver salt (a) and the light-sensitive silver halide (b). In general, component (d) is added when additives such as a reducing agent, a sensitizing dye, a toning agent, etc., are added. However, it is also possible to add component (d) upon formation of the organic silver salt (a) or upon formation of the light-sensitive silver halide (b).

Known anti-fogging agents can be used in combination with component (d). For example, a combination of a thiosulfonic acid with component (d) or a combination of a sulfinic acid with component (d) is particularly preferred. A suitable amount of the thiosulfonic acid ranges from about $10^{-4}$ to about 1 mol, preferably $10^{-3}$ to $10^{-1}$ mol, per mol of component (d). A suitable amount of the sulfinic acid ranges from about $10^{-3}$ to about 10 mol, preferably $10^{-2}$ to about 1 mol, per mol of component (d). Suitable thiosulfonic acids which can be used are described in Japanese patent application (OPI) No. 78,227/76 (corresponding to U.S. patent application Ser. No. 644,685, filed Dec. 29, 1975), and suitable sulfinic acids are described in Japanese patent application (OPI) No. 123,331/75 (corresponding to U.S. patent application Ser. No. 558,607, filed Mar. 14, 1975).

It is also preferable to use an acid stabilizer such as rosin, long-chain aliphatic carboxylic acids (e.g., diterpenic acid, stearic acid, behenic acid, etc.), aromatic carboxylic acids (e.g., phthalic acid, benzoic acid, salicylic acid, etc.), dicarboxylic acids (e.g., succinic acid, 1,14-tetradecanedicarboxylic acid, etc.), or the like described in Japanese patent application (OPI) No. 57,435/76 (corresponding to U.S. patent application Ser. No. 632,885, filed Nov. 17, 1975) in combination with component (d). A suitable amount of the acid stabilizer ranges from about $10^4$ to $10^{-2}$ mol, preferably from about $10^3$ to $10^{-1}$ mol, per mol of component (d).

Other anti-fogging agents which are usable in the present invention in combination with component (d) include, for example, mercury compounds, N-halo compounds, lithium salts, peroxides, persulfates, rhodium salts, cobalt salts, palladium salts, cerium salts, disulfides, polymer acids, etc. Specific examples are described in U.S. Pat. No. 3,589,903, Japanese patent application (OPI) Nos. 10,724/74, 97,613/74, 90,118/74, 22,431/76, U.S. Pat. No. 3,885,968, Japanese patent application (OPI) Nos. 101,019/75, 116,024/75, 134,421/75, 47,419/76, 42,529/76, 51,323/76, Japanese patent application Nos. 28,851/75, 96,155/75, U.S. Pat. Nos. 4,002,479, 4,003,749 and 4,009,039, etc.

The organic silver salts to be used in the present invention as component (a) are colorless, white or slightly colored silver salts, which react, when heated to not less than about 80° C., preferably not less than 100° C., with a reducing agent in the presence of an exposed photocatalyst (b) such as silver halide to form silver (image). Examples of organic silver salts (a) which can be used are silver salts of organic compounds containing an imino group, a mercapto group, a thione group or a carboxyl group. Specific examples of suitable organic silver salts are as follows.

(1) Examples of organic compounds containing an imino group:

For example, silver salts as described, e.g., in Japanese patent application (OPI) No. 22,431/76, such as silver salts of benzotriazoles, the silver salt of saccharin, silver salts of phthalazinones, silver salts of phthalimides, etc.

(2) Examples of compounds containing a mercapto group or a thione group:

For example, silver salts as described in, e.g., Japanese patent application (OPI) No. 22,431/76, U.S. Pat. Nos. 3,933,507, 3,785,830, etc., such as the silver salt of 2-mercaptobenzoxazole, the silver salt of mercaptooxadiazole, the silver salt of 2-mercaptobenzothiazole, the silver salt of 2-mercaptobenzimidazole, the silver salt of 3-mercapto-4-phenyl-1,2,4-triazole, etc.

(3) Organic silver salts containing a carboxyl group:

For example, (i) silver salts of aliphatic carboxylic acids as described in, e.g., Japanese patent application (OPI) No. 22,431/76, U.S. Pat. No. 3,457,075, Japanese patent application (OPI) No. 99,719/75, etc., such as silver laurate, silver myristate, silver palmitate, silver stearate, silver arachidonate, silver behenate, silver salts of aliphatic carboxylic acids having 23 or more carbon atoms, silver adipate, silver sebacate, silver hydroxystearate, etc.; (ii) silver salts of aromatic carboxylic acids and the like as described in, e.g., Japanese patent application (OPI) Nos. 22,431/76, 99,719/75, etc., such as silver benzoate, silver phthalate, silver phenylacetate, silver 4'-n-octadecyloxydiphenyl-4-carboxylate, etc.

(4) Silver salts of other compounds:

For example, silver salts described in, e.g., Japanese patent application (OPI) Nos. 22,431/76 and 93,139/75, such as the silver salt of 4-hydroxy-6-methyl-1,3,3a,7-tetrazaindene, the silver salt of 5-methyl-7-hydroxy-1,2,3,4,6-pentazaindene, etc.

Where a silver halide or a silver-dye light-sensitive complex is used as a photocatalyst (b), organic silver salts (a) which are comparatively stable against light are suitable as the above-described organic silver salts. In particular, silver salts of long-chain aliphatic carboxylic acids having 10 to 40, particularly 18 to 33, carbon atoms are preferred. More specifically, silver salts of the formula $CH_3(CH_2)_{n_1}COOH$ ($n_1$:16 to 31), which may be used in combination, if desired, are preferred.

The amount of the organic silver salts as component (a) which can be used is about 0.1 g to about 4 g (as silver), preferably about 0.2 g to about 2.5 g, per $m^2$ of the support (to be described hereinafter). If less than about 0.1 g per $m^2$ is used, the image density will be too low, whereas, if more than about 4 g per $m^2$ is used, the amount of silver is increased without an increase in image density, leading to a high production cost.

Various processes for preparing such organic silver salts are described in U.S. Pat. Nos. 3,457,075, 3,458,544, 3,700,458, 3,839,049, British Patents 1,405,867, 1,173,426, Japanese patent application (OPI) No. 22,431/76, Japanese patent application No. 45,997,75, etc. These processes can be summarized as follows. That is, solution A prepared by dissolving or dispersing an organic silver salt-forming agent (e.g., an imino compound, a carboxylic acid, a mercapto compound, a thione compound or salt thereof) in a suitable solvent (e.g., water, an aliphatic hydrocarbon, an ester, a ketone, a halogenated hydrocarbon, an ether, an aromatic hydrocarbon, an alcohol, an oil, etc.) is mixed with solution B prepared by dissolving or dispersing a silver salt capable of forming an organic silver salt (e.g., silver nitrate, silver trifluoroacetate, silver tetrafluoroborate, silver perchlorate, etc.) in a suitable solvent (e.g., water, an alcohol, an acid amide, an amine, aqueous ammonia, a ketone, acetonitrile, dimethylsulfoxide, an aromatic hydrocarbon, pyridine, an aliphatic hydrocarbon, etc.) to prepare the organic silver salt (a). Specific examples of the above-described solvents are toluene, xylene, water, cyclohexane, cyclohexene, dodecene, pentane, hexane, heptane, butyl acetate, amyl acetate, pentyl acetate, tricresyl phosphate, castor oil, methyl alcohol, ethyl alcohol, propyl alcohol, butyl alcohol, acetone, dioxane, methyl ethyl ketone, methyl isobutyl ketone, methylene chloride, dibutyl phthalate, dioxane, dimethylformamide, ammonia, acetonitrile, etc., which, however, are not to be construed as limitative at all.

The reaction is conducted at an optional temperature in the range of from about −80° C. to about 100° C., preferably from about −20° C. to about 70° C. The reaction time is optionally selected in the range of from about 0.01 second to about 150 hours, preferably from about 0.1 second to about 72 hours. The reaction is conducted under an optional pressure in the range of from about $10^{-2}$ mm Hg to about 300 atmospheres, preferably at atmospheric pressure. The concentration of the solution or dispersion is optionally selected in the range of from about $10^{-2}$% by weight to about $10^{2}$% by weight, usually from about 1% by weight to about 50% by weight.

As is described in British Pat. No. 1,408,123, ultrasonic waves may be employed during the preparation of the organic silver salt (a). Also, in order to change the particle size and particle form of the organic silver salt and/or photographic properties such as heat stability, light stability, photo sensitivity, fog, etc., polymers, metal-containing compounds or surface active agents may be co-present during the preparation of the organic silver salt. Examples of such polymer are polyvinyl butyral as described in U.S. Pat. No. 3,700,458 and Japanese patent application No. 133,692/75 and examples of the metal of the metal-containing compounds are manganese, nickel, iron and cerium as well as mercury, lead, chromium, cobalt, rhodium, etc., as described in British Pat. No. 1,378,734, Japanese patent application (OPI) Nos. 22,430/76, 116,024/75 and 134,421/75. Suitable amounts of the surface active agent and the polymer are from about 0.1 g to about 1,000 g, preferably from about 1 g to about 500 g, per mol of the organic silver salt (a), and a suitable amount of the metal-containing compound is from about $10^{-6}$ mol to about $10^{-1}$ mol per mol of the organic silver salt (a) and from about $10^{-5}$ to about $10^{-2}$ mol per mol of the silver halide (b).

The particle size of the thus-prepared organic silver salt (a) ranges from about 10μ to about 0.01μ, preferably from about 5μ to about 0.1μ, in length.

Component (b) of the present invention renders the thermally developable light-sensitive material light-sensitive and functions as a catalyst for the oxidation-reduction image-forming reaction between component (a) and component (c).

Preferably, the photocatalyst component (b) used in the present invention is silver chloride, silver bromide, silver iodide, silver chlorobromoiodide, silver chlorobromide, silver chloroiodide, silver bromoiodide or a mixture thereof. The amount of such a light-sensitive silver halide as component (b) which can be used ranges from about 0.001 mol to about 0.5 mol, preferably from about 0.01 mol to about 0.3 mol, per mol of the organic silver salt (a). A preferred grain size (length) of the silver halide ranges from about 2μ to about 0.001μ, preferably from about 0.5μ to about 0.01μ. The light-sensitive silver halide (b) is prepared as an emulsion using an optional process known in the photographic field, such as the single jet process, a double jet process, etc. For example, a Lippmann emulsion, an ammoniacal emulsion, a thiocyanate- or thioether-ripened emulsion, etc., can be used. The light-sensitive silver halide as component (b) thus previously prepared is then mixed with an oxidation-reduction composition comprising an organic silver salt (a) and a reducing agent (c). This is described in U.S. Pat. No. 3,152,904. Various techniques have been made to achieve sufficient contact between the silver halide (b) and the organic silver salt (a). One is a technique of adding a surface active agent, examples of which are described in U.S. Pat. No. 3,761,273, Japanese patent application (OPI) Nos. 32,926/75 and 32,928/75. Another approach is a process comprising mixing the prepared silver halide as component (b) in a polymer with the organic silver salt (a), examples of which are described in U.S. Pat. Nos. 3,706,565, 3,706,564, 3,713,833, British Pat. No. 1,362,970, etc. A further process comprises decomposing a silver halide emulsion with an enzyme and mixing the product with the organic silver salt, as described in British Pat. No. 1,354,186.

The silver halide to be used in the present invention as component (b) may be prepared almost simultaneously with the formation of the organic silver salt as component (a) as is described in Japanese patent application (OPI) No. 17,216/75. A still further process comprises reacting a light-sensitive silver halide-forming component (to be described hereinafter) on a previously prepared solution or dispersion of the organic silver salt (a) or on an organic silver salt-containing sheet with a layer containing an organic silver salt to thereby convert a part of organic silver salt (a) to light-sensitive silver halide for component (b). U.S. Pat. No. 3,457,075 describes that using this method the thus-formed silver halide is in effective contact with the organic silver salt and is advantageous.

On the other hand, the component capable of forming a light-sensitive silver halide as component (b) is a compound capable of forming silver halide by reacting with the organic silver salt (a). To determine whether a compound is suitable, a simple test as follows can be used. That is, the silver halide-forming component is reacted with the organic silver salt (a) and, if necessary, after heating, the product is examined using an X-ray diffraction method to determine whether a diffraction peak characteristic of silver halide is present or not.

The conditions for forming the silver halide as component (b) are as follows. The reaction temperature is in the range of from about −80° C. to about 100° C., preferably from about −20° C. to about 90° C. The reaction time is in the range of from about 0.01 second to about 150 hours, preferably from about 0.1 second to about 72 hours. The reaction pressure is in the range of from about $10^{-2}$ mm Hg to about 300 atmospheres pressure, with atmospheric pressure being preferred.

Components capable of forming light-sensitive silver halides include inorganic halides, halogen-containing metal complexes, onium halides, halogenated hydrocarbons, N-halo compounds, and other halogen-containing compounds. Specific examples thereof are described in detail in Japanese patent application (OPI) No. 22,431/76, U.S. Pat. No. 3,457,075, Japanese patent application (OPI) Nos. 78,316/75, 115,027/75 and 9,813/76, some of which are illustrated below.

(1) Inorganic silver halides:

For example, halides represented by, e.g., $M'X_{n'}$ (wherein M' represents H, $NH_4$ or a metal atom, X represents Cl, Br or I, and n' represents 1 when M' is H or $NH_4$ or, when M' is a metal atom, n' represents the valence of the metal) such as NaBr, LiBr, $HgBr_2$, $CaBr_2$, $AuCl_4$, etc.

(2) Halogen-containing metal complexes:

For example, $K_2PtCl_6$, $K_2PtBr_6$, $HAuCl_4$, $(NH_4)_2IrCl_6$, $(NH_4)_3IrCl_6$, $(NH_4)_2RuCl_6$, $(NH_4)_3RhCl_6$, $(NH_4)_3RhBr_6$, etc.

(3) Onium halides:

For example, quaternary ammonium halides (e.g., trimethylphenyl ammonium bromide, cetylethyldimethylammonium bromide, trimethylbenzylammonium bromide, etc.), quaternary phosphonium halides (e.g., tetraethylphosphonium bromide, etc.), tertiary sulfonium halides (e.g., trimethylsulfonium iodide, etc.), etc.

(4) Halogenated hydrocarbons:

For example, iodoform, bromoform, carbon tetrabromide, 2-bromo-2-methylpropane, etc.

(5) N-Halo compounds:

For example, N-chlorosuccinimide, N-bromosuccinimide, N-bromophthalimide, N-bromoacetamide, N-iodosuccinimide, N-bromophthalazone, N-bromooxazoline, N-chlorophthalazone, N-bromoacetanilide, N,N-dibromobenzenesulfonamide, N-bromo-N-methylbenzenesulfonamide, 1,3-dibromo-4,4-dimethylhydantoin, trichloroisocyanuric acid, etc.

(6) Other halogen-containing compounds:

For example, triphenylmethyl chloride, triphenylmethyl bromide, 2-bromobutyric acid, 2-bromoethanol, dichlorobenzophenone, triphenyl bromide, etc.

Such light-sensitive silver halide-forming components may be used individually or as a combination of two or more thereof. The amount thereof ranges from about 0.001 mol to about 0.5 mol, preferably from about 0.01 mol to about 0.3 mol, per mol of the organic silver salt component (a). If the amount is less than about 0.001 mol, low sensitivity results, whereas if more than about 0.5 mol is used, light discoloration (undesirable coloration of background areas generated when the processed light-sensitive materials are allowed to stand under normal room light) will increase.

Using any process, the produced silver halide can be sensitized with, for example, a sulfur-containing compound, a gold compound, a platinum compound, a palladium compound, a silver compound, a tin compound, etc., or a combination thereof. Descriptions relating to sensitization are given in, e.g., Japanese patent application Nos. 115,386/74, 122,902/74, 143,178/74, 13,074/75, 45,646/75, 81,181/75, etc.

Similar improvements in photographic properties can be attained, for example, by forming the silver halide in the presence of a part of binder, precipitating the silver halide by centrifugation or the like, and re-dispersing the precipitate in the remainder of the binding agent, i.e., by applying a precipitating method known in the art of gelatino-silver halide emulsions. It is also possible to change the photographic properties by allowing nitric acid, potassium ferricyanide, a thiocyanate, a thiosulfate, benzotriazoles, tetrazaindenes, mercapto compounds, thione compounds, iodides, heavy metal salts such as rhodium salts, etc., to be present during preparation.

Other photocatalysts may also be used as component (b) in place of silver halide. For example, a light-sensitive complex between silver and a dye which has at least one functional group such as a thione group, a mercapto group, a sulfone group, a cyano group or a carboxyl group as described in Japanese patent publication No. 25,498/74, Japanese patent application (OPI) Nos. 4,728/71 and 28,221/73 may be used as the photocatalyst and, as is described in Japanese patent application (OPI) No. 8,522/75, a highly sensitive organic silver salt and a low sensitive organic silver salt may be used in combination as the organic silver salt (a). In addition, metal diazosulfonates and sulfinates as described in U.S. Pat. No. 3,152,904 are also suitable as the photocatalyst (b). Also, photoconductive materials such as zinc oxide, titanium oxide, etc., can be used as the photocatalyst (b). Where highly sensitive thermally developable light-sensitive materials are required, it is most advantageous to use silver halide as the photocatalyst (b).

Some optical sensitizing dyes which are said to be effective for a gelatino-silver halide emulsion also exhibit a sensitizing action on the thermally developable light-sensitive material of the present invention. Effective optical sensitizing dyes which can be used in the present invention include cyanines, merocyanines, rhodacyanines, complex (tri- or tetra-nuclear) cyanines or merocyanines, holopolar cyanines, styryls, hemicyanines, oxonols, hemioxonols, xanthene dyes, etc. Of the cyanine dyes, those which contain a basic nucleus such as a thiazoline nucleus, an oxazoline nucleus, a pyrroline nucleus, a pyridine nucleus, an oxazole nucleus, a thiazole nucleus, a selenazole nucleus, an imidazole nucleus, etc., are more preferred. In addition, cyanine dyes containing an imino group or a carboxyl group are effective. /Merocyanine dyes may contain an acidic nucleus such as a thiohydantoin nucleus, a rhodanine nucleus, an oxazolidinedione nucleus, a thiazolidinedione nucleus, a barbituric acid nucleus, a thiazolinone nucleus, a malononitrile nucleus, a pyrazolone nucleus, etc., in addition to the above-described basic nuclei. In particular, merocyanine dyes containing an imino group or a carboxyl group are effective.

Particularly effective sensitizing dyes for the thermally developable light-sensitive material of the present invention are merocyanine dyes having a rhodanine nucleus, a thiohydantoin nucleus, or a 2-thio-2,4-oxazolidinedione nucleus, etc., as described in U.S. Pat. No. 3,761,279, Japanese patent application (OPI) Nos. 105,127/75, 104,637/75, etc.

In addition, trinuclear merocyanine dyes described in U.S. Pat. No. 3,719,495, sensitizing dyes mainly for silver iodide described in Japanese patent application (OPI) No. 17,719/74, styrylquinoline dyes described in British Pat. No. 1,409,009, rhodacyanine dyes as described in U.S. Pat. No. 3,877,943, acidic dyes (e.g., 2',7'-dichlorofluorescein dye) as described in Japanese patent application (OPI) Nos. 96,717/74, 102,328/74, British Pat. No. 1,417,382, etc., merocyanine dyes as described in Japanese patent application (OPI) No. 156,424/75, Japanese patent application No. 101,680/74, etc., and the like may similarly be used in the present invention.

These dyes are employed in an amount of from about $10^{-4}$ mol to about 1 mol per mol of component (b), the silver halide or the silver halide-forming component.

Component (c), the reducing agent, to be used in the present invention preferably is a compound capable of reducing an organic silver salt (component (a)) upon being heated in the presence of exposed silver halide or a like photocatalyst. Suitable reducing agents (c) actually usable are decided depending on the kind and property of the organic silver salt (a) used.

Suitable reducing agents (c) include bis-, tris- or tetrakis-phenols, mono- or bis-naphthols, di- or poly-hydroxynaphthalenes, di- or poly-hydroxybenzenes, hydroxymonoethers, ascorbic acids, 3-pyrazolidones, pyrazolines, pyrazolones, reducing saccharides, phenylenediamines, hydroxylamines, reductones, hydroxamic acids, hydrazides, amidoximes, N-hydroxyureas, etc. Specific examples thereof are described in detail in Japanese Patent Application (OPI) No. 22,431/76, U.S. Pat. Nos. 3,615,533, 3,679,426, 3,672,904, 3,751,252, 3,751,255, 3,782,949, 3,801,321, 3,794,488, 3,893,863, Belgian Pat. No. 786,086, U.S. Pat. Nos. 3,770,448, 3,819,382, 3,773,512, 3,928,686, 3,839,048, 3,887,378, Japanese patent application (OPI) Nos. 15,541/75, 36,143/75, U.S. Pat. No. 3,827,889, Japanese patent application (OPI) Nos. 36,110/75, 116,023/75, 147,711/75, 23,721/76, Japanese patent application Nos. 105,290/74, 126,366/74, etc.

Of these compounds, polyphenols, sulfonamidophenols and naphthols are particularly preferred as reducing agents (c).

Specific examples of polyphenols are 2,4-dialkyl substituted orthobisphenols, 2,6-dialkyl substituted parabisphenols and mixtures thereof. Specific examples of such compounds are 1,1-bis(2-hydroxy-3,5-dimethylphenyl)-3,5,5-trimethylhexane, 1,1-bis(2-hydroxy-3-t-butyl-5-methylphenyl)methane, 1,1-bis(2-hydroxy-3,5-di-t-butylphenyl)methane, 2,6-methylenebis(2-hydroxy-3-t-butyl-5-methylphenyl)-4-methylphenol, 6,6'-benzylidene-bis(2,4-di-t-butylphenol), 6,6'-benzylidene-bis(2-t-butyl-4-methylphenol), 6,6'-benzylidene-bis(2,4-dimethylphenol), 1,1-bis(2-hydroxy-3,5-dimethylphenyl)-2-methylpropane, 1,1,5,5-tetrakis-(2-hydroxy-3,5-dimethylphenyl)-2,4-ethylpentane, 2,2-bis(4-hydroxy-3,5-dimethylphenyl)propane, 2,2-bis(4-hydroxy-3-methyl-5-t-butylphenyl)propane, 2,2-bis(4-hydroxy-3,5-di-t-butylphenyl)-propane, etc.

Preferred specific examples of naphthols include 2,2'-dihydroxy-1,1'-binaphthyl, 6,6'-dibromo-2,2'-dihydroxy-1,1'-binaphthyl, 6,6'-dinitro-2,2'-dihydroxy-1,1'-binaphthyl, bis(2-hydroxy-1-naphthyl)methane, 4,4'-dimethoxy-1,1'-dihydroxy-2,2'-binaphthyl, etc.

Also, preferred specific examples of sulfonamidophenols are 4-benzenesulfonamidophenol, 2-benzenesulfonamidophenol, 2,6-dichloro-4-benzenesulfonamidophenol, etc. In addition to the above-described specific examples, additional specific examples are described in Japanese patent application (OPI) Nos. 22,431/76, 36,110/75, 116,023/75, 147,711/75, 23,721/76, Japanese patent application Nos. 105,290/74, 126,366/74, Japanese patent application (OPI) No. 15,541/75, U.S. Pat. Nos. 3,672,904, 3,801,321, etc.

Where phenylenediamines are used as a reducing agent (c), color images can be obtained by using such in combination with phenolic color couplers or active methylene-containing color couplers as described in U.S. Pat. Nos. 3,531,286 and 3,764,328. Similarly, color images can be obtained according to U.S. Pat. No. 3,761,270.

Of the above-described reducing agents for component (c), mono-, bis-, tris- or tetrakis-phenols having at least in one of the two adjacent positions to a hydroxy-substituted position of the aromatic nucleus an alkyl group or an acyl group (e.g., a methyl group, an ethyl group, a propyl group, an isopropyl group, a butyl group, an acetyl group, a butyryl group, etc.), for example, a 2,6-di-t-butylphenol group have the advantage that they suffer less discoloration with light due to their high stability against light, and are, therefore, particularly preferred. Also, as is described in U.S. Pat. No. 3,827,889, reducing agents which are inactivated by light such as light-decomposable reducing agents are preferred since they are decomposed or inactivated by light when the light-sensitive material is allowed to stand in a bright room after development. This serves to eliminate light discoloration since reduction capability is eliminated. Suitable light-decomposable reducing agents include ascorbic acid or the derivatives thereof, furoin, benzoin, dihydroxyacetone, glycerinaldehyde, rhodizonic acid, tetrahydroxyquinone, 4-methoxy-1-naphthol, and aromatic polysulfides described in Japanese patent application (OPI) No. 99,719/75. As is described in U.S. Pat. Nos. 3,827,889 and 3,756,829, it is also possible to prepare a thermally developable light-sensitive material using such a light-decomposable reducing agent and obtain direct positive images by image-wise exposing the material to thereby decompose the reducing agent. Further, compounds capable of accelerating the light decomposition of the reducing agent can be used in combination therewith.

Suitable reducing agents (c) are selected depending upon the kind (property) of the organic silver salts used as component (a). For example, stronger reducing agents are suitable for silver salts which are comparatively difficult to reduce such as the silver salt of benzotriazole, silver behenate, etc., whereas weaker reducing agents are suitable for silver salts which are comparatively easy to reduce such as silver caprate, silver laurate, etc. Reducing agents suitable for the silver salt of benzotriazole are, for example, 1-phenyl-3-pyrazolidones, ascorbic acid, ascorbic acid monocarboxylic acid esters, naphthols (e.g., 4-methoxy-1-naphthols, etc.), and the like. Suitable reducing agents for silver behenate include many compounds such as o-bisphenols of the bis(hydroxyphenyl)methane series, hydroquinone, and the like. Also, suitable reducing agents for silver caprate and silver laurate are substituted tetrakis-phenols, o-bisphenols of the bis(hydroxyphenyl)alkane series, p-bisphenols (e.g., bisphenol A derivatives), p-phenylphenols, and the like.

As the method for selecting suitable reducing agents (c), the method of preparing a light-sensitive material as shown in the Examples given hereinafter and evaluating the superiority or inferiority of the reducing agents is the simplest method for those skilled in the art.

The amount of the reducing agent (c) which is used in the present invention will vary depending upon the kinds of organic silver salt and the reducing agent and upon other additives present but, in general, a suitable amount ranges from about 0.05 mol to about 10 mols, preferably from about 0.1 to about 3 mols, per mol of the organic silver salt (a).

The above-described various reducing agents (c) may be used individually or as a combination of two or more thereof.

A toning agent can be used together with the reducing agent. This toning agent is often employed where dark images, in particular black images, are desired. The amount thereof to be used ranges from about 0.0001 mol to about 2 mols, preferably from about 0.0005 mol to about 1 mol, per mol of the organic silver salt (a). Effective toning agents depend upon the organic silver salt (a) and the reducing agent (c) to be used. However, the most generally used toning agents are imino compounds and mercapto compounds.

Suitable toning agents are phthalazinones, oxazinediones, cyclic imides, urazoles, 2-pyrazolin-5-ones, etc. More specific examples are described in U.S. Pat. Nos. 3,846,136, 3,782,941, 3,844,797, 3,832,186, 3,881,938, 3,885,967, British Pat. No. 1,380,795, Japanese patent application (OPI) Nos. 151,138/75, 91,215/74, 67,132/75, 67,641/75, 114,217/75, 32,927/75, 22,431/76, Japanese patent application No. 16,128/76, etc., some of which are illustrated below, e.g., phthalazinone, N-acetylphthalazinone, N-hydroxyethylphthalazinone, phthalimide, N-hydroxyphthalimide, benzoxazinedione, uracil, etc.

The use of two or more of these toning agents in combination often improves photographic properties such as shelf life, etc.

In order to prevent discoloration by light of processed thermally developable light-sensitive materials of the present invention (the phenomenon that the unexposed areas of the light-sensitive materials are gradually discolored upon being exposed to normal room illumination after processing), stabilizer precursors such as azole thioethers described in U.S. Pat. No. 3,839,041, or blocked azole thiones, tetrazolylthio compounds described in U.S. Pat. No. 3,700,457 and light-sensitive, halogen-containing organic oxidizing agents described in U.S. Pat. No. 3,707,377, halogen-containing compounds described in Japanese patent application (OPI) No. 119,624/75 and U.S. Pat. No. 3,874,946, 1-carbamoyl-2-tetrazoline-5-thiones described in U.S. Pat. No. 3,893,859, sulfur as described in Japanese patent application (OPI) No. 26,019/76, etc., can be used.

Each component to be used in the present invention is dispersed in at least one colloid which functions as a binder. Preferred binders are generally hydrophobic, though hydrophilic binders may also be used. These binders are transparent or semi-transparent and include, for example, proteins such as gelatin, etc., polysaccharides such as cellulose derivatives, dextran, etc., naturally occurring materials such as gum arabic, and synthetic polymers. Preferred binders are described in Japanese patent application (OPI) No. 22,431/76. Particularly preferred binders include polyvinyl butyral, polyvinyl acetate, ethyl cellulose polymethyl methacrylate, cellulose acetate butyrate gelatin, and polyvinyl alcohol. If desired, two or more binders may be used in combination. The proportion of the binder ranges from about 10:1 to about 1:10, preferably from about 4:1 to about 1:4, by weight based on the organic silver salt, component (a).

A layer or layers containing the respective components to be used in the thermally developable light-sensitive material of the present invention can be coated on the support, e.g., components (a), (b), (c) and (d) of this invention can be present in the same layer or different layers or various combinations of layers can be used, e.g., components (a), (b) and (d) can be present in the same layer and component (c) can be present in a layer adjacent the layer containing components (a), (b) and (d). Other layers can also be coated on the support, if desired. Various materials can be used for the support. Supports of any shape can generally be used but, since flexible supports are preferred for handling as information-recording materials, film- or sheet-shaped supports, supports in the form of a roll or of a ribbon are usually used.

Suitable materials for the support include synthetic resin films, sheets, glasses, wool, cotton, paper, metals such as aluminum and the like. Examples of synthetic resin films include cellulose acetate films, polyester films such as polyethylene terephthalate films, polyamide films, polyimide films, cellulose triacetate films, polycarbonate, films, etc.

Also, as suitable paper supports, in addition to general paper, photographic paper, printing paper (e.g., coated paper, art paper, etc.), baryta paper, resin-coated paper, water-proof paper, papers subjected to sizing with a polysaccharide or the like as described in Belgian Pat. No. 784,615, pigment paper containing titanium dioxide or the like, papers coated with an $\alpha$-olefin polymer (e.g., polyethylene, polypropylene, ethylene-butene copolymers, etc.), papers previously processed with polyvinyl alcohol, etc., can be used.

The thermally developable light-sensitive material of the present invention can contain an antistatic layer, an electroconductive layer, a vacuum-deposited metal layer, a subbing layer, and a backing layer, if desired.

Also, as is described in Belgian Pat. No. 798,367, U.S. Pat. Nos. 3,856,526, 3,856,527, 3,933,508, Japanese patent application (OPI) No. 128,726/74, etc., a top-coated polymer layer can be provided, if desired, on a light-sensitive layer in order to increase the transparency of the thermally developable light-sensitive layer and to improve the heat resistance of the layer. The film thickness of the top-coated polymer layer is suitably from about $1\mu$ to about $20\mu$. Suitable polymers for such a top-coated polymer layer include polyvinyl chloride, a vinylidene chloride-vinyl chloride copolymer, polyvinyl acetate, a vinyl chloride-vinyl acetate copolymer, polystyrene, methyl cellulose, ethyl cellulose, cellulose acetate butyrate, cellulose acetate, vinylidene chloride, polycarbonate, gelatin, polyvinyl alcohol, etc.

Incorporation of titanium dioxide, kaolin, zinc oxide, silica, alumina, polysaccharide (e.g., starch) or a like carrier in the top-coated polymer layer enables the element to be written upon using stamp ink, a ball-point pen, a pencil or the like.

If desired, various additives known for gelatinosilver halide light-sensitive materials, such as an antihalation agent, an antihalation dye, a brightening dye, a filter dye, a light-absorbing agent, a fluorescent brightening agent, a plasticizer, a lubricant, a surface active agent, a hardener, etc., may be used in the thermally developable light-sensitive material of the present invention. In addition, a matting agent such as calcium carbonate, starch, titanium dioxide, zinc oxide, silica, dextrin, barium sulfate, aluminum oxide, clay, diatomaceous earth, kaolin, etc., may be incorporated in the thermally developable light-sensitive material of the present invention.

A specific process for preparing the thermally developable light-sensitive material of the present invention is outlined as follows. That is, an organic silver salt-forming compound and a silver ion-supplying agent such as silver nitrate are reacted with each other according to a process hereinbefore described to prepare an organic silver salt. The thus-prepared organic silver salt is washed with water, an alcohol, etc., then dispersed in a binder for an emulsion. A colloid mill, a mixer, a ball mill or the like can be used for the dispersion. To the thus-prepared polymer dispersion of the silver salt is added a silver halide-forming agent to thereby convert a part of the organic silver salt into silver halide. Alternatively, it is also possible to add a previously prepared silver halide or to form a silver halide simultaneously with the formation of the organic silver salt. Then, various additives such as sensitizing dyes, reducing agents, toning agents, etc., are added in sequence, preferably as a solution thereof. After the addition of all of the additives, a coating composition results. This coating composition is coated as such on a suitable support without drying. Similarly with the thermally developable light-sensitive layer formed through the above-described procedures, a top-coated polymer layer, a subbing layer, a backing layer and other layers can be formed by preparing respective coating solutions thereof and coating, in sequence, using various coating processes such as a dip-coating process, an air-knife coating process, a curtain coating process or a hopper coating process. If desired, two or more layers can be coated at the same time according to the process as described in U.S. Pat. No. 2,761,791 and British Pat. No. 837,095.

Printing can be applied, if desired, to the surface or back of a support or the layer provided on the support. Thus, printing of predetermined patterns enables the thermally developable light-sensitive material of this invention to be used as (commuting) tickets for vehicles, post cards or other documents.

After the thus-prepared thermally developable light-sensitive material is cut into a suitable size for use, it is image-wise exposed. The material may be pre-heated (e.g., about 80° C. to about 140° C.), if desired, before exposure. Suitable light sources which can be used for the image-wise exposure include various light-sources such as a tungsten lamp, a fluorescent lamp for copying mainly used for exposing diazo light-sensitive materials, a mercury lamp, an iodine lamp, a xenon lamp, a CRT light source, a laser light source, etc. Photographic images having a gradation therein may be used as well as line images of drawings as an original to be copied. In addition, it is also possible to use the material to take a picture of people or scenery using a camera. Contact printing by superposing an original thereon, reflection printing or enlargement-printing can be employed as the printing method. The exposure amount will vary depending upon the sensitivity of the light-sensitive material, but a suitable exposure is about 10 lux.sec with respect to a highly sensitive light-sensitive material, or about $10^4$ lux.sec with respect to a low sensitive light-sensitive material. The thus image-wise exposed light-sensitive material can be developed by merely heating (e.g., to about 80° to 180° C., preferably about 100° C. to about 150° C.) the material. The heating time can be optionally selected between about 1 to about 60 seconds. This is dependent upon the heating temperature used. Various heating means can be employed. For example, the thermally developable light-sensitive material may be brought into contact with a simple heated plate or a heated drum. In some cases, the material may be passed within a heated space. Also, high frequency induction heating or laser beam heating may be employed as described in U.S. Pat. No. 3,811,885. In order to prevent an offensive odor from being generated upon heating, a deodorant may be provided in the processing machine. Also, certain perfumes may be incorporated in the material to prevent the offensive odor from the light-sensitive material from being detected.

When the thermally developable light-sensitive material of the present invention is used, heat fog is effectively prevented and the material has a wide latitude for thermal development, thus it is quite useful. In addition, the material has the excellent property that its characteristic properties (i.e., latitude for thermal development and sensitivity) are not changed or deteriorated even when the material is stored for a long period of time.

The present invention will now be illustrated in more detail by reference to the following non-limiting examples. Unless otherwise indicated herein, all parts, percents, ratios and the like are by weight.

EXAMPLE 1

34 g of behenic acid was mixed with 500 ml of water and the mixture was heated to 85° C. to melt the behenic acid. To the behenic acid melted at 85° C. and water mixture was added, while stirring at 1800 rpm, a sodium hydroxide aqueous solution (2.0 g of sodium hydroxide in 50 cc of water) (at 25° C.) over a 3 minute period to prepare a mixture of sodium behenate and behenic acid. Then, the temperature was reduced from 85° C. to 30° C. while stirring the mixture at 1,800 rpm.

Then, while continuing the stirring, a silver nitrate aqueous solution (8.5 g of silver nitrate in 50 cc of water) (at 25° C.) was added thereto over a 3 minute period, and the stirring was continued for an additional 90 minutes. 200 cc of isoamyl acetate was added thereto, and the thus-formed silver behenate particles were recovered. Then, the particles were dispersed in a polyvinyl butyral isopropanol solution (25 g of polyvinyl butyral in 200 cc of isopropanol) using a homogenizer (at 25° C., 3,000 rpm, 30 minutes) to prepare a polymer dispersion of silver behenate.

Then, this polymer dispersion of silver behenate was maintained at 50° C. and, while stirring at 500 rpm, a solution (0.7 g of N-bromosuccinimide in 50 cc of acetone) (at 25° C.) was added thereto, and the stirring was continued for an additional 60 minutes to prepare a polymer dispersion of silver bromide and silver behenate. 1/12th of this silver bromide-silver behenate polymer dispersion (1/240 mol) was removed and, while stirring at 200 rpm at 30° C., the following components were added at 5 minute intervals to prepare Coating Composition (A).

(i) Merocyanine Dye (sensitizing dye) of the Following Formula (0.025 wt% methyl Cellosolve solution)—2 ml

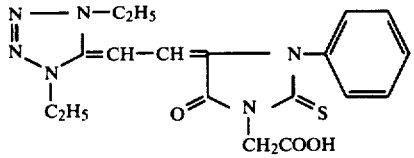

(ii) Sodium Benzenethiosulfonate (anti-fogging agent) (0.02 wt% methanol solution)—2 ml (iii) Compound (8) of the Present Invention (0.5 wt% acetone solution)—2 ml (iv) Phthalazinone (toning agent) (3 wt% methanol solution)—7 ml (v) o-Bisphenol of the Following Formula (reducing agent) (10 wt% acetone solution)—10 ml

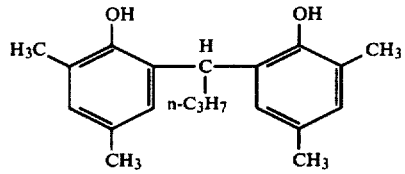

Separately, Coating Composition (B) was prepared in absolutely the same manner as Coating Composition (A) except that (ii) sodium benzenethiosulfonate was not added.

For the purposes of comparison, Coating Composition (C) was prepared in absolutely the same manner as Coating Composition (A) except that (iii) Compound (8) of the present invention was not added.

Further, for the purposes of comparison, Coating Composition (D) was prepared in absolutely the same manner as Coating Composition (A) except that (ii) sodium benzenethiosulfonate and (iii) Compound (8) of the present invention were not added.

The thus-prepared four Coating Compositions (A) to (D) were coated on a support (polyvinyl alcohol-subbed base paper for a pressure-sensitive paper) in an amount of 0.3 g silver/$m^2$ to prepare Thermally Developable Light-Sensitive Materials (A), (B), (C) and (D), respectively.

The thus-prepared thermally developable light-sensitive materials were exposed, immediately after preparation, with light from a tungsten lamp through an optical wedge (maximum exposure amount: 3,000 CMS), and were brought into contact with a heated plate for 8 seconds or 11 seconds at 130° C. to conduct thermal development.

Separately, Thermally Developable Light-Sensitive Materials (A), (B), (C) and (D) were left for 7 days under conditions of 40% in relative humidity and 35° C. in temperature (hereinafter merely referred to as incubation), and exposed and thermal developed under the same conditions as described above.

The reflection density of these samples was measured to examine the photographic properties thereof. The results of the development at 130° C. for 8 seconds are shown in Table 1, and the results of the development at 130° C. for 11 seconds are shown in Table 2.

TABLE 1

| Light-Sensitive Material | Immediately after Preparation | | | After Incubation | | |
|---|---|---|---|---|---|---|
| | Fog | $D_{max}$ | Relative Sensitivity* | Fog | $D_{max}$ | Relative Sensitivity* |
| A | 0.05 | 1.36 | 105 | 0.06 | 1.37 | 105 |
| B | 0.35 | 1.39 | 85 0.45 | 1.38 | 65 | |
| C | 0.20 | 1.38 | 100 | 0.25 | 1.38 | 60 |
| D | 0.69 | 1.39 | — | 0.85 | 1.40 | — |

TABLE 2

| Light-Sensitive Material | Immediately after Preparation | | | After Incubation | | |
|---|---|---|---|---|---|---|
| | Fog | $D_{max}$ | Relative Sensitivity* | Fog | $D_{max}$ | Relative Sensitivity* |
| A | 0.08 | 1.38 | 125 | 0.10 | 1.38 | 118 |
| B | 0.40 | 1.40 | 95 | 0.52 | 1.39 | 65 |
| C | 0.30 | 1.38 | 110 | 0.40 | 1.38 | 55 |

TABLE 2-continued

| Light-Sensitive Material | Immediately after Preparation | | | After Incubation | | |
|---|---|---|---|---|---|---|
| | Fog | $D_{max}$ | Relative Sensitivity* | Fog | $D_{max}$ | Relative Sensitivity* |
| D | 0.95 | 1.40 | — | 1.15 | 1.40 | — |

*Relative sensitivity is indicated in terms of the reciprocal of the exposure amount necessary to produce a density of fog + 0.1, taking the sensitivity of Light-Sensitive Material (C) developed at 130° C. for 8 seconds as 100.

It is clear, from a comparison of Light-Sensitive Material (A) with Light-Sensitive Material (C) and a comparison of Light-Sensitive Material (B) with Light-Sensitive Material (D), that Compound (8) of the present invention has an excellent anti-fogging action. In addition, comparison of Light-Sensitive Material (A) with Light-Sensitive Material (C) clearly reveals that Compound (8) of the present invention prevents desensitization caused by incubation.

It is clear, from a comparison of Light-Sensitive Materials (A) and (B) with Light-Sensitive Material (C), that the combined use of Compound (8) of the present invention and sodium benzenethiosulfonate much more strongly prevents fog (see the results in Tables 1 and 2).

Differences in fog between development at 130° C. for 11 seconds and development at 130° C. for 8 seconds, determined from Tables 1 and 2, are shown in Table 3.

TABLE 3

| Light-Sensitive Material | Immediately after Preparation (difference in fog) | After Incubation (difference in fog) |
|---|---|---|
| A | 0.03 | 0.04 |
| B | 0.05 | 0.07 |
| C | 0.10 | 0.15 |
| D | 0.26 | 0.30 |

From a comparison of Light-Sensitive Material (A) with Light-Sensitive Material (C) and from a comparison of Light-Sensitive Material (B) with Light-Sensitive Material (D) in Table 3, it is clear that Compound (8) of the present invention has the action of expanding the latitude for development.

EXAMPLE 2

Four Thermally Developable Light-Sensitive Materials (E), (F), (G) and (H) were prepared in the same manner as Thermally Developable Light-Sensitive Materials (A), (B), (C) and (D) in Example 1, respectively, except that 3 ml of a 0.2 wt% methanol solution of sodium benzenesulfinate was used in place of (ii) sodium benzenethiosulfonate and 2 ml of a 0.6 wt% acetone solution of Compound (6) of the present invention was used in place of (iii) Compound (8) of the present invention, and then subjected to absolutely the same testing as in Example 1 (developing conditions: 130° C., 8 seconds).

Table 4 shows the compositions of the thermally developable light-sensitive materials, and Table 5 shows the photographic properties thereof.

TABLE 4

| Thermally Developable Light-Sensitive Material | (ii) Sodium Benzenesulfinate | (iii) Compound (6) of the Invention |
|---|---|---|
| E | Present | Present |
| F | Not Present | Present |

TABLE 4-continued

| Thermally Developable Light-Sensitive Material | (ii) Sodium Benzenesulfinate | (iii) Compound (6) of the Invention |
|---|---|---|
| G | Present | Not Present |
| H | Not Present | Not Present |

TABLE 5

| Light-Sensitive Material | Immediately after Preparation | | | After Incubation | | |
|---|---|---|---|---|---|---|
| | Fog | $D_{max}$ | Relative Sensitivity* | Fog | $D_{max}$ | Relative Sensitivity* |
| E | 0.15 | 1.35 | 108 | 0.18 | 1.35 | 110 |
| F | 0.40 | 1.36 | 95 | 0.50 | 1.37 | 85 |
| G | 0.35 | 1.33 | 100 | 0.40 | 1.35 | 45 |
| H | 0.69 | 1.39 | — | 0.85 | 1.40 | — |

* Relative sensitivity of Light-Sensitive Material G was taken as 100.

From a comparison of Light-Sensitive Material (E) with Light-Sensitive Material (G) and a comparison of Light-Sensitive Material (F) with Light-Sensitive Material (H), it is clear that Compound (6) of the present invention has excellent anti-fogging action.

In addition, from a comparison of Light-Sensitive Material (E) with Light-Sensitive Material (G), it is clear that Compound (6) of the present invention prevents desensitization caused by incubation.

From a comparison of Light-Sensitive Materials (E) and (F) with Light-Sensitive Material (G), it is clear that the combined use of Compound (6) of the present invention with sodium benzenesulfinate much more strongly prevents fog.

EXAMPLES 3–7

Light-sensitive materials shown in Table 6 were prepared in absolutely the same manner as Light-Sensitive Material (A) in Example 1 except that the following compounds were used in place of Compound (8) of the present invention, and subjected to the same tests as in Example 1 (developing conditions: 130° C., 8 seconds).

TABLE 6

| Example No. | Light-Sensitive Material | Component (d) of the Present Invention | |
|---|---|---|---|
| 3 | I | 0.5% Acetone solution of Compound (1) | 2 ml |
| 4 | J | 0.6% Acetone solution of Compound (13) | 3 ml |
| 5 | K | 0.5% Acetone solution of Compound (21) | 3 ml |
| 6 | L | 0.5% Acetone solution of Compound (22) | 3 ml |
| 7 | M | 0.5% Acetone solution of Compound (37) | 2 ml |

TABLE 7

| Example No. | Light-Sensitive Material | Immediately after Preparation | | | After Incubation | | |
|---|---|---|---|---|---|---|---|
| | | Fog | $D_{max}$ | Relative Sensitivity* | Fog | $D_{max}$ | Relative Sensitivity* |
| 3 | I | 0.06 | 1.38 | 103 | 0.08 | 1.38 | 100 |
| 4 | J | 0.06 | 1.39 | 105 | 0.07 | 1.38 | 106 |
| 5 | K | 0.09 | 1.37 | 100 | 0.12 | 1.38 | 102 |
| 6 | L | 0.08 | 1.36 | 99 | 0.10 | 1.35 | 93 |
| 7 | M | 0.09 | 1.37 | 101 | 0.13 | 1.38 | 100 |

TABLE 7-continued

| Example No. | Light-Sensitive Material | Immediately after Preparation | | | After Incubation | | |
|---|---|---|---|---|---|---|---|
| | | Fog | $D_{max}$ | Relative Sensitivity* | Fog | $D_{max}$ | Relative Sensitivity* |
| 1 | C | 0.20 | 1.38 | 100 | 0.25 | 1.38 | 60 |

* Relative sensitivity of Light-Sensitive Material C was taken as 100.

The excellent anti-fogging action and anti-desensitization action of Compounds (1), (13), (21), (22) and (37) of the present invention are clear from the results in Tables 6 and 7.

While the invention has been described in detail and with reference to specific embodiments thereof, it will be apparent to one skilled in the art that various changes and modifications can be made therein without departing from the spirit and scope thereof.

What is claimed is:

1. A thermally developable light-sensitive material comprising a support having therein or in at least one layer thereon (a) an organic silver salt, (b) a light sensitive silver halide or a component capable of forming a light sensitive silver halide upon reaction with said organic silver salt (a), and (c) a reducing agent, and additionally (d) at least one 1,2,4-triazole compound represented by the following formula (I):

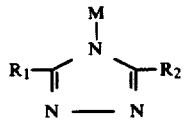

(I)

wherein M represents a hydrogen atom or an alkali metal atom and $R_1$ and $R_2$, which may be the same or different, each represents a halogen atom, a nitro group or a carbon-containing substituent selected from the group consisting of an alkyl group having 1 to 18 carbon atoms, which may be straight chain, branched chain or cyclic and which may be substituted with one or more of a halogen atom, a hydroxyl group, a carboxyl group or a carbon-containing substituent having 1 to 12 carbon atoms; an aryl group having 6 to 18 carbon atoms which may be monocyclic or bicyclic and which may be substituted with one or more of a halogen atom, a nitro group, a hydroxy group, a carboxy group or a carbon-containing substituent having 1 to 12 carbon atoms; a substituted oxy group, a substituted thio group, a substituted sulfinyl group, a substituted sulfonyl group or a substituted amino group having the general formulas, respectively:

R'—O—

R'—S—

R'—$SO_2$—

R'—$SO_3$—

$R'_n$—$NH_m$— or R''=N— wherein n and m each represents 0 or an integer of 1 to 2, where n+m is equal to 2, and R' represents a carbon-containing substituent having 1 to 12 carbon atoms and wherein R'' represents a 5- or 6-membered heterocyclic ring containing a nitrogen atom which may form a fused ring together with a benzene nucleus and which may be substituted with one or more alkyl groups having 1 to 4 carbon atoms; or a 5- or 6-membered heterocyclic ring which may form a fused ring together with a benzene ring and which may be substituted with one or more alkyl groups having 1 to 4 carbon atoms;

wherein said component (d) is added after formation of a mixture of said component (a) and component (b).

2. The thermally developable light-sensitive material of claim 1, wherein said material additionally contains an acid stabilizer selected from the group consisting of a rosin, a long-chain aliphatic carboxylic acid, an aromatic carboxylic acid and a dicarboxylic acid.

3. The thermally developable light-sensitive material of claim 1, wherein said organic silver salt (a) is a silver salt of a long-chain aliphatic carboxylic acid having 10 to 40 carbon atoms.

4. The thermally developable light-sensitive material of claim 1, wherein said organic silver salt (a), said light-sensitive silver halide or said component capable of forming said light-sensitive silver halide (b), said reducing agent (c) and said 1,2,4-triazole compount (d) are all present in the same layer on said support.

5. The thermally developable light-sensitive material of claim 1, wherein said organic silver salt (a), said light-sensitive silver halide or said component capable of forming said light-sensitive silver halide (b) and said 1,2,4-triazole compound (d) are all present in the same layer on said support and said reducing agent (c) is present in a layer adjacent said layer containing said organic silver salt (a), said light-sensitive silver halide or said component capable of forming said light-sensitive silver halide (b) and said 1,2,4-triazole compound (d).

6. The thermally developable light-sensitive material of claim 1, wherein said 1,2,4-triazole compound is

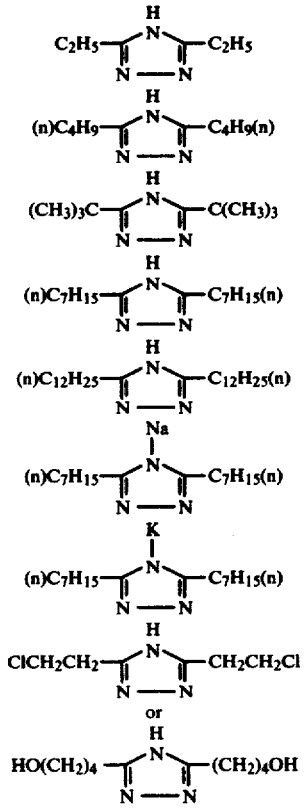

7. The thermally developable light-sensitive material of claim 1, wherein said 1,2,4-triazole compound is present in an amount of about $10^{-5}$ mol to 0.5 mol per mol of said organic silver salt (a).

8. The thermally developable light-sensitive material of claim 1, wherein said material additionally contains at least one of a thiosulfonic acid or a sulfinic acid.

9. The thermally developable light-sensitive material of claim 1, wherein said organic silver salt is a silver salt of an organic compound containing an imino group, a mercapto group, a thione group or a carboxyl group.

* * * * *